US006035567A

United States Patent [19]

Cameron

[11] Patent Number: 6,035,567

[45] Date of Patent: Mar. 14, 2000

[54] HAZARD WARNING SIGN

[76] Inventor: Robert W. Cameron, 4972 Northwest Rd., Bellingham, Wash. 98226

[21] Appl. No.: 08/685,066

[22] Filed: Jul. 23, 1996

[51] Int. Cl.[7] ..... G09F 21/02

[52] U.S. Cl. ..... 40/606; 40/586; 40/607; 116/63 P

[58] Field of Search ..... 40/606, 607, 455, 40/586, 555; 116/3, 63 P; 362/109, 183

[56] References Cited

U.S. PATENT DOCUMENTS

| | | | |
|---|---|---|---|
| 1,032,102 | 7/1912 | Anderson, Jr. | 116/3 X |
| 1,349,063 | 8/1920 | Gordon | 116/3 X |
| 3,821,860 | 7/1974 | Patty | 40/555 |
| 4,042,919 | 8/1977 | Patty | 40/586 X |
| 4,108,405 | 8/1978 | Gibson | 40/455 |
| 5,276,424 | 1/1994 | Hegemann | 40/586 X |
| 5,283,595 | 2/1994 | Krukovsky | 40/606 X |
| 5,381,319 | 1/1995 | Shiao | 362/109 X |
| 5,422,638 | 6/1995 | Singer et al. | 116/63 P |
| 5,755,051 | 5/1998 | Zumbuhl | 40/586 |

*Primary Examiner*—Cassandra H. Davis
*Attorney, Agent, or Firm*—Todd N. Hathaway

[57] ABSTRACT

A hazard warning sign assembly having a sign plate displaying a warning message, and at least one flashing light and horn for generating visual and audible signals for attracting attention to the sign. A rechargeable battery pack forms a detachable handle for the sign plate and the signal housing. A telescoping pole portion mounted to the lower end of the elongate battery pack is provided for height adjustment of the assembly. Manually operable switch buttons control actuation of the flashing light and horn units.

11 Claims, 5 Drawing Sheets

HAZARD WARNING SIGN

BACKGROUND a. Field of the Invention

The present invention relates generally to warning signs, and, more particularly, to portable traffic warning and control signs for use by road crews, policemen, firemen, crossing guards, and the like.

b. Background

As is known, portable warning signs and flags are commonly used to control vehicular traffic at various road sites, including construction areas, crosswalks, and emergency scenes. While reasonably effective under ideal conditions, traditional signs and flags exhibit several deficiencies, which are at least partly at fault for numerous accidents every year.

For example, roadside flagmen are often difficult to see at dawn or dusk or under adverse weather conditions, and therefore are frequently struck by traffic, even though they are normally required to wear high visibility clothing. Also, because the sign itself is difficult to see, it may go unnoticed or be misinterpreted by motorists under these conditions, which may result in a collision with oncoming traffic.

Pedestrian traffic, especially at school crossings, presents a somewhat similar situation. In addition to the problems noted above, a particularly dangerous condition can develop when a large vehicle is stopped at the crossing and blocks the view of following motorists. For example, an impatient motorist behind a large truck, unable to see the crosswalk and/or crossing guard ahead, may assume that the vehicle is stopped for some purpose such as loading/unloading. Under these circumstances, the motorist will sometimes yield to the temptation to pull out and pass the truck without realizing that the crosswalk is there, and then strike the children in the street.

Similar situations exist at accident scenes and the like, where a policeman, fireman, or other emergency response personnel need to warn or stop oncoming traffic. However, somewhat different from roadside flagmen and crossing guards, emergency response personnel typically need a more portable warning device, which will fit in the trunk of a patrol car or the like.

Accordingly, there is a need for a traffic warning and/or control sign which can be seen by drivers even under conditions of adverse visibility. Furthermore, there exists a need for such a device which will attract the attention of drivers, even when they are fatigued or hurried. Still further, there is a need for such a device which will provide motorists with an indication of the approaching condition or hazard, even when direct view of the scene and traffic control sign are blocked by some object, such as a large truck or other vehicle.

SUMMARY OF THE INVENTION

The present invention has solved the problems cited above. Broadly, this is a hazard warning sign assembly comprising: (a) a sign plate having at least one surface for displaying a warning message, (b) flashing light means mounted adjacent the display surface for generating a visual warning signal, (c) horn means mounted to the sign plate for generating a audible warning signal, (d) battery means connected to the warning sign for supplying electrical power to the horn means and flashing light means, and (e) switch means for selectively actuating the horn means and flashing light means so as to draw attention to the sign assembly.

The battery means may comprise an elongate battery pack assembly mounted to a lower end of the sign plate so as to form a handle member therefor. The elongate battery pack may comprise an elongate tubular housing forming a chamber for holding a plurality of cylindrical batteries in end-to-end relationship.

The sign assembly may further comprise telescoping pole means mounted to a lower end of the elongate battery housing, the telescoping pole means being selectively extensible so as to adjust an overall height of the assembly. The telescoping pole means may comprise an inner tubular member which is fixedly mountable to the lower end of the tubular battery housing, an outer tubular member in telescoping the extendable relationship with the inner tubular member, and locking means for selectively locking the inner and outer tubular members together in various extended positions. There may also be a support base having a socket portion for receiving a lower end of the telescoping pole means so as to hold the sign assembly in an upright position.

The sign assembly may further comprise a signal housing for mounting the horn means and flashing light means together adjacent the display surface of the sign plate. The signal housing may be mounted to an upper end of the sign plate, opposite the elongate tubular housing, so that the horn means and flashing light means are positioned at an uppermost end of the sign assembly when held upright. The assembly may further comprise support means for connecting the elongate tubular battery housing to the signal housing atop the sign plate; this may be a tubular rod member extending from the elongate battery housing to the signal housing, the rod member having a hollow tubular core for receiving wire leads interconnecting the battery means and the horn/flashing light means, and a vertically extending slot for receiving the sign plate edgewise therein.

The sign assembly may further comprise means for selectively connecting the battery means to a battery charger unit. Moreover, the assembly may further comprise means for detachably mounting the sign plate and signal housing to an upper end of the elongate battery pack, and means for detachably mounting the telescoping pole means to a lower end of the battery pack. The mounting means may be threaded coupler members having cylindrical portions which are received in the ends of the elongate tubular housing.

The battery means may also comprise a remote battery pack configured to be carried separately by an operator. There may also be a safety vest having a carrying pouch for holding the remote battery pack, and an elongate power cord for connecting the battery pack with the sign assembly. There may be also at least one personal safety light mounted to the vest and connected to the remote battery pack which is carried therein.

BRIEF DESCRIPTION OF THE DRAWINGS

FIG. 1A is a second elevational view of the hazard warning sign of FIG. 1, this having been rotated to show the second display surface on the reverse side thereof;

DETAILED DESCRIPTION a. Overview

Figure 1A:
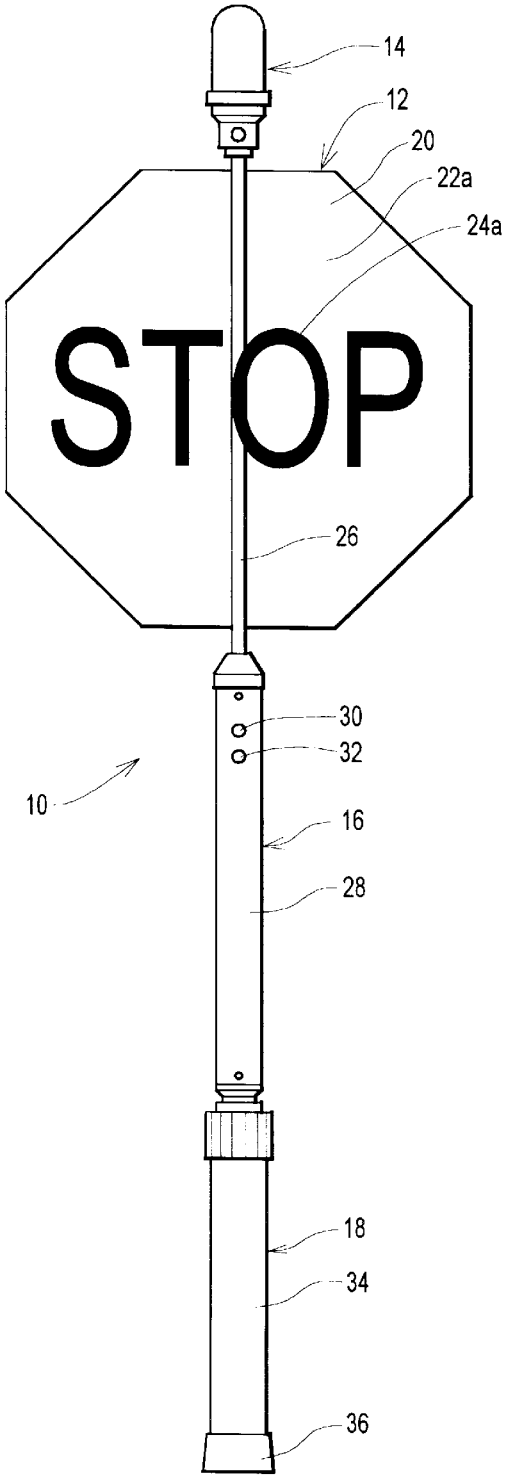
FIG. 1A is an elevational view of a hazard warning sign in accordance with the present invention, this having an integral power supply and means for generating visual and audible warning signals.

FIG. 1A shows a hazard warning sign assembly 10 in accordance with the present invention. As can be seen, the assembly is made up of (a) a display panel section 12, (b) a combined warning light and audible signal section 14, (c) a power/control section 16, and (d) a telescoping pole section 18. As will be described in greater detail below, the hazard warning sign 10 thus provides both visual and audible signals to draw the person's attention to the written warning which is displayed on the panel section of the sign.

Figure 1B:
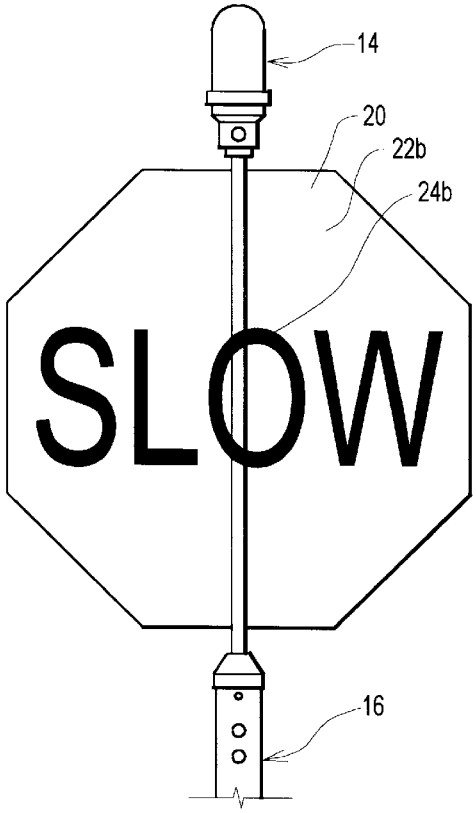

As can be seen in FIG. 1A, the panel assembly 12 includes a sign plate 20 having first and second display surfaces 22*a*, 22*b* (22*b* being shown in FIG. 1B) in which appropriate warnings may be painted or otherwise displayed. For example, in the embodiment which is illustrated in FIGS. 1A–1B, which is adapted mainly for roadside traffic control use, the first side 22*a* displays the word "STOP" or other legend 24*a*, while the opposite side 22*b* displays the word "SLOW" or other legend 24*b*, as shown in FIG. 1B; in this and other embodiments in which the word "STOP" is displayed, the sign plate 20 preferably has an octagonal configuration corresponding to that of conventional stop signs, with at least the "STOP" side being red in color.

A hollow support rod 26 extends vertically across sign plate 20, with the combination warning light/audible warning assembly 14 being mounted on the upper end of this and the power/control assembly being attached to its lower end. The rod member 26 has a vertically extending slot (not shown) cut completely therethrough, into which the sign plate 20 is inserted edgewise and secured using screws or other attachments. In addition to holding the sign plate, the rod member also supplies support for the light/horn assembly 14, and a conduit for wire leads supplying power from the power/control assembly 16. The rod member may be formed of any suitable tubular material, with ¾-inch electrical conduit being eminently suitable for this purpose.

As will be described in greater detail below, the power/control assembly 16 is provided with an elongate tubular housing 28 for holding one or more batteries which supply electrical power to the light/horn assembly 16. First and second finger actuated control buttons 30, 32 are provided so as to enable the operator to selectively actuate the horn and flashing light individually or simultaneously.

The telescoping pole assembly 18, in turn comprises an extensible tubular support section 34 having a non-skid base 36 which rests on the ground. As will be described in greater detail below, when the support section is in its retracted configuration, its length is such that, in combination with the housing of the power/control assembly, the actuating controls 30, 32 are positioned at or slightly above shoulder height, for convenient operation by a person while holding the assembly 10. Then, to position the sign plate and visual/audible warning assembly at a higher elevation, the support section can be telescoped to an increased length and then placed in a support (not shown), with the controls for the light/horn assembly having previously been actuated by the operator.

Accordingly, the combination of the light and horn in the assembly 14 provides strong visual and audible signals for drawing the attention of personnel to the warning sign, overcoming the problems described above. The light in assembly 14 has an appropriate color (red, blue, amber) indicative of a hazard or emergency, and flashes on and off with sufficient rapidity to enhance its visual impact. Moreover, the light source is selected to be sufficiently bright that buildings, embankments, vegetation, vehicles, and other objects in the vicinity are at least partially illuminated by and reflect the colored light so that motorists and other persons are made aware of the warning even if their direct view of the sign assembly is blocked. Moreover, the audible warning is not affected by visual obstacles, and the horn unit is selected to be sufficiently loud that it will be heard by drivers in the vicinity, even with the vehicle windows closed.

Still further, in those embodiments of the invention which are intended for use at school crossings, the loud horn provides an audible cue to the children that it is safe to cross, even if they have not been watching the sign itself. This is an important feature, in that children waiting at a school crossing will frequently be involved in conversation or otherwise distracted so that they will not be watching the sign itself, and a sudden visual cue (such as the movement of a child wearing a red shirt or dress) may be misinterpreted as the movement of a sign or flag. Accordingly, when using the present invention, the problem of school children stepping into the street at the wrong time can be eliminated by instructing the children not to enter the crossing until they see the flashing light and hear the horn signal.

b. Visual/Audible Warning Assembly

FIG. 2 shows the audible/visible warning assembly 14 of FIGS. 1A–1B in enlarged detail. As can be seen, this includes a housing 38 having a base ring 40 which threads onto or otherwise mounts to the upper end of the tubular support rod 26.

The upper portion of the housing provides a base connection 42 for a warning light 44 having a domed plastic enclosure. As was noted above, the warning light is preferably bright enough that it provides a visible reflection or glare off of nearby objects. Although any suitable light source may be used, a high intensity strobe light is eminently suitable for this purpose, both because of its brilliance and its virtually instantaneous on/off time. The dome member or other lens fitted to the light unit has a suitable color for indicating the presence of a hazard or emergency, such as red for stop (or fire), amber for slow (or caution), blue for police, and so forth; for the sign assembly shown in FIGS. 1A–1B, having "STOP" on one side and "SLOW" on the other, the lens is preferably a combination red-amber unit. The flash rate, in turn, may have any cycle time which is suitable for attracting the attention of motorists and other persons with rate and range from about 60–180 cycles per minute being suitable for many application; for best visibility, however, the flash rate should not be so fast that persons perceive it as a continuous beacon, as opposed to a series of distinct flashes.

The audible warning signal, in turn, is provided by a powerful horn unit 46 which is mounted in housing 38, below the strobe light 44. Preferably, the horn unit is at least bi-directional, i.e., it faces outwardly from both sides of the side plate, and in some embodiments the horn unit may be omni-directional.

Figure 2A:
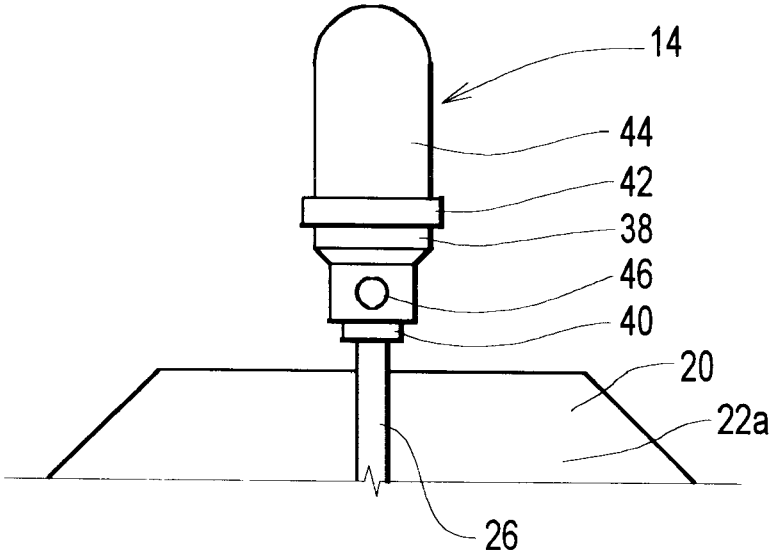
FIG. 2A is an enlarged, elevational view of the combination visual/audible warning assembly atop the sign assembly of FIGS. 1A–1B.
Figure 2B:
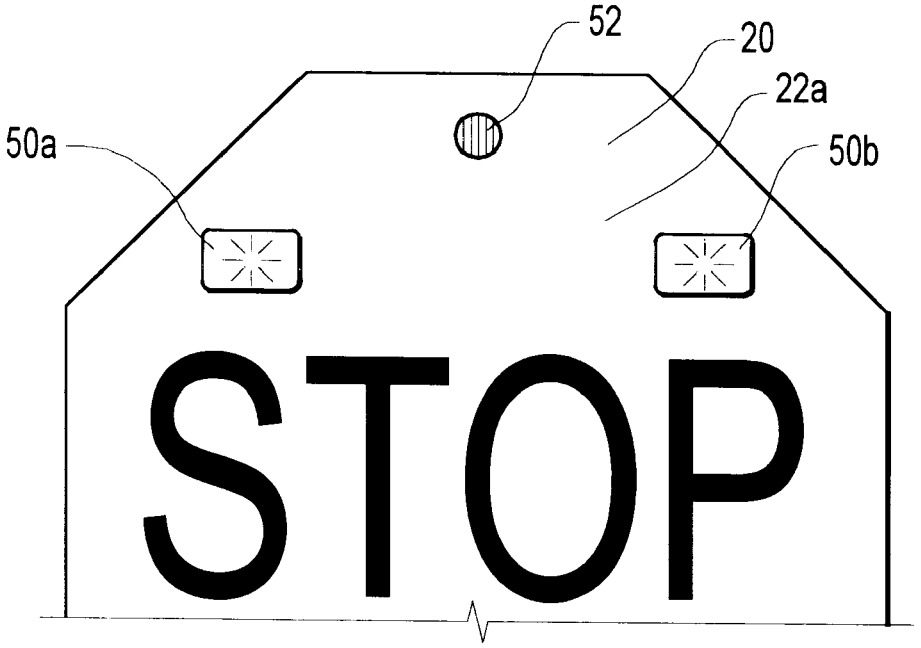
FIG. 2B is an elevational view similar to FIG. 2A, showing the upper part of a sign assembly having a visual/audible warning assembly in accordance with a second embodiment of the present invention, in which there are spaced apart light units which flash alternately so as to attract attention to the sign.

Although the placement of the visual and audible signals at the top of the side assembly as shown in FIG. 2A has the advantage of increasing both visibility of the light and the effective range of the horn unit, it will be understood that numerous other placements may be used for these components. For example, FIG. 2B shows a second embodiment of the invention in which each display surface of the sign plate (only the first display surface 22*a* being shown in FIG. 2B) is provided with a plurality of spaced apart flashing light units. As shown in FIG. 2B, there are left and right strobe light units 50*a*, 50*b* which are roughly level with one another, but are spaced apart from each other near opposite edges of the sign plate 20. The other display surface 22*b* (not shown) may be provided with first and second light units of its own, or the light units 50*a*, 50*b* may be mounted so that these extend through the sign plate so as to be visible from both sides; this latter arrangement has the advantages of economy of manufacture and lower power usage.

The two spaced apart light units 50*a*, 50*b* are timed (by means of the power/control assembly) to flash on an alternating basis, i.e., the first unit is illuminated while the other is off and vice versa. This shift in the position of the light source is perceived as "motion" by the observer, enhancing the assembly's ability to draw attention thereto. The position of the horn unit 52 may be at any suitable location in this embodiment, with a position near the upper part of the sign being preferably again for achieving maximum projection.

Although only two alternating light units 50*a*, 50*b* are shown in FIG. 2B, it will be understood that a plurality comprising any suitable number of light units may be used in this embodiment, so long as these are spaced apart or arranged in array so as to impart a degree of perceived "motion" to the light pattern.

c. Power/Control Unit

Figure 3:
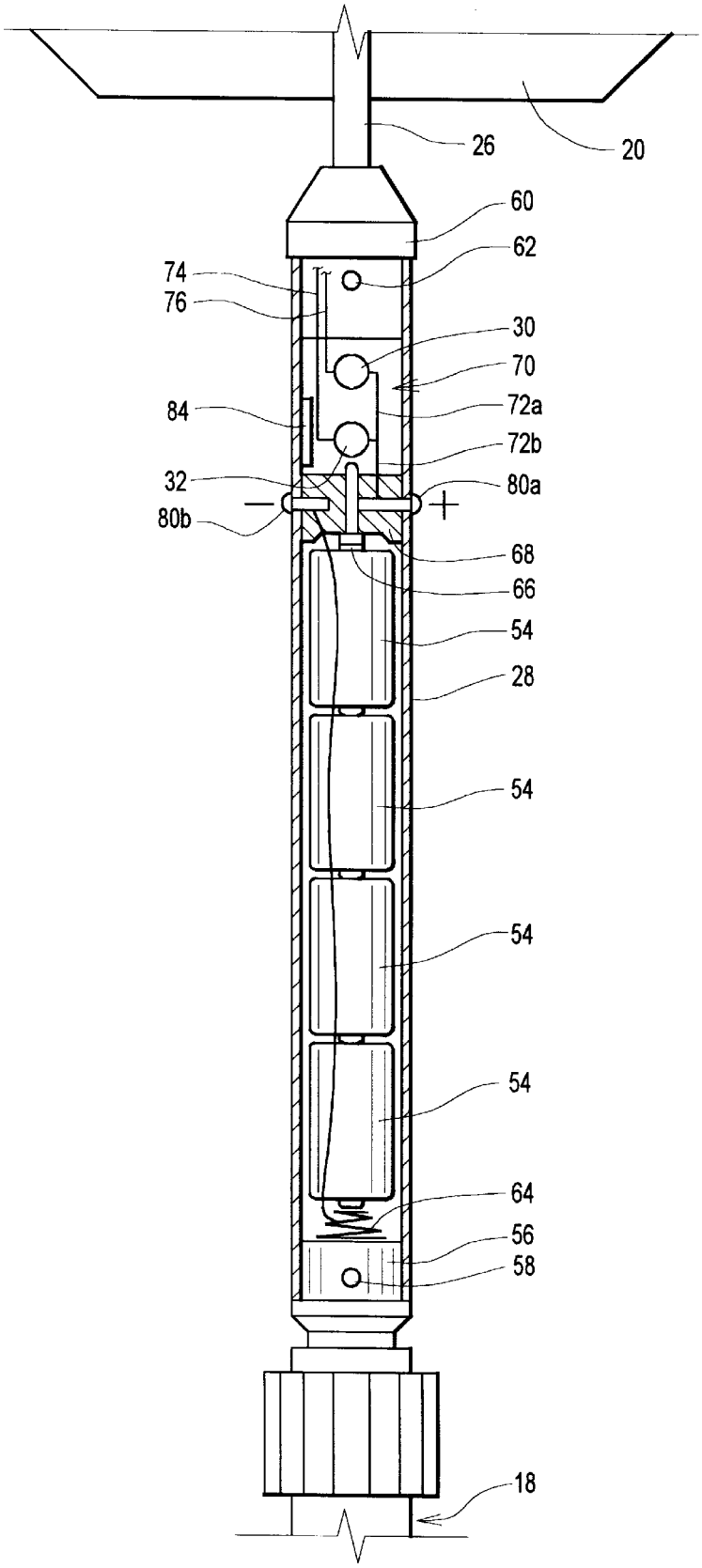
FIG. 3 is an enlarged elevational view of the battery pack/power control assembly of the sign assembly shown in FIGS. 1A–1B, with the tubular case being cut away in this view to show the batteries, electrical contacts and other components which are enclosed therein.

FIG. 3 shows the tubular power/control assembly 16 in enlarged detail. As was noted above, the main structural member of this section is the elongate tubular housing 28. In the embodiment which is illustrated in FIG. 3, this housing is provided by a plastic or metal tube having an internal diameter which is sized to accommodate a plurality of "D" cell batteries 54 in end-to-end relationship, and an external diameter which is sized to be conveniently grasped by an operator using one hand. The bottom end of the tubular housing 28 is plugged by an internally threaded female coupler 56 which is secured in place by a set screw 58; similarly, the upper end of the housing is closed by an internally threaded tubing reducer 60 which is secured in the tube by a second set screw 62. As will be described in greater detail below, the threaded bore of the upper reducer 60 receives the threaded lower end of the rod member 26, while the lower coupler 56 receives a threaded male coupler which is attached to the telescoping pole assembly 18.

A coil spring 64 mounted in the bottom of the tubular housing 28 atop the female coupler provides the negative electrical contact for batteries 54, while a positive electrical contact is provided by a post 66 which is mounted centrally in a plastic battery stop 68 in the upper part of the housing, this latter being in the form of a generally cylindrical plug which is fitted inside the tubing. In the embodiment which is shown, the chamber which formed between the battery stop and the lower female coupler is sized to hold four "D" cell batteries; it will be understood, however, that the length of this chamber, as well as the diameter of the housing, may be varied as desired to accommodate more or fewer batteries, or different types or sizes.

The area between the battery stop 68 and the lower end of the tubing reducer 60 forms a wiring compartment 70 which accommodates the two button switches 30, 32 and their associated connections. For example, as can be seen in FIG. 3, these connections include the power input leads 72*a*, 72*b* to the button switches, and the output leads 74, 76 therefrom which supply power to the strobe and horn units, respectively; as was noted above, the output leads are threaded up through the interior of the tubular rod member 26 to the visual/audible warning assembly which is mounted to the top thereof.

The battery stop 68 also provides the mounting area for positive and negative contacts 80*a*, 80*b* for recharging the batteries 54, which are preferably of the rechargeable nicad type. The positive charging contact is connected to post 66 within the battery stop, while the negative contact is connected to coil spring 64 via negative lead 82, which also extends up to the metal rod member 26 so as to complete the circuit for the light and horn units. Also, a charge cutout circuit 84 (as are known to those skilled in the art) is mounted in the lead 82, in chamber 70, for interrupting the power circuit during charging of the batteries.

Accordingly, when the batteries become discharged, or between work shifts, the power/control assembly can be installed in a conventional battery charger unit (not shown) which is configured to engage the positive and negative contacts 80*a*, 80*b*, so that the charge on the unit can be renewed for the next work period. If it is desired to continue use of the rest of the sign assembly while the battery pack is charging, the upper and lower assemblies can be detached from the tubular power/control assembly 16 using the threaded connections which are shown in FIGS. 4–5.

Figure 4:
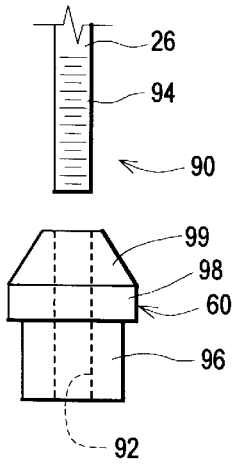
FIG. 4 is an elevational view of the components making up the upper connector assembly which detachably joins the power/control section to the sign plate/warning signal section of the sign assembly shown in FIGS. 1A–1B.

As can be seen in FIG. 4, the upper threaded connection 90 is made up of the upper tubing reducer 60 having a threaded bore 92, and the threaded lower end 94 of the vertical rod member 26. As can also be seen, the lower part of the tubing reducer is formed by a cylindrical plug portion 96 which is sized to fit closely within the bore of the tubular housing 28, and an outwardly extending shoulder portion 98 at the upper end of this which abuts the upper edge of the tube. A frustoconical upper wall 99 extends above the shoulder portion 98 to provide a smoother, damage resistant transition between the rod 26 and the reducer 60.

Figure 5:
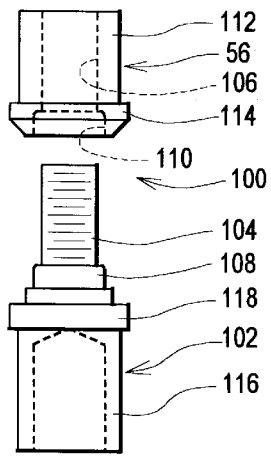
FIG. 5 is an elevational view of the components making up the lower connection assembly which detachably joins the bottom of the power/control section to the telescoping pole section.

FIG. 5, in turn, shows the lower threaded connection 100, which is made up of the lower female coupler 56 which fits in the end of the tubular housing 28 and the male coupler 102 which is attached to the telescoping pole assembly 18. As can be seen, the male coupler has an upwardly extended threaded stud 104 which engages a threaded bore 106 in the female coupler 56. A radial, radiused shoulder 108 around the base of the threaded stud is received in a corresponding socket portion 110 in the bottom of the female connection, to provide more even weight distribution and relieve stress on the threads themselves. As with the reducer 60 described above, the female coupler 56 has a cylindrical plug portion 112 which fits within the bottom of the tubular housing 28, and an outwardly extending shoulder portion 114 which butts up against the lower edge of the tube to hold the member in place; similarly, the male coupler 102 is provided with a plug portion 116 and shoulder portion 118 by which it is mounted to the telescoping pole assembly 18.

In addition to the screw-type connections which have been described above, it will also be understood that bayonet-type couplings or similar attachments may be employed to provide the detachable connections between the elongate battery/control assembly and the upper and lower sections of the sign assembly.

d. Telescoping Pole Assembly

Figure 6:
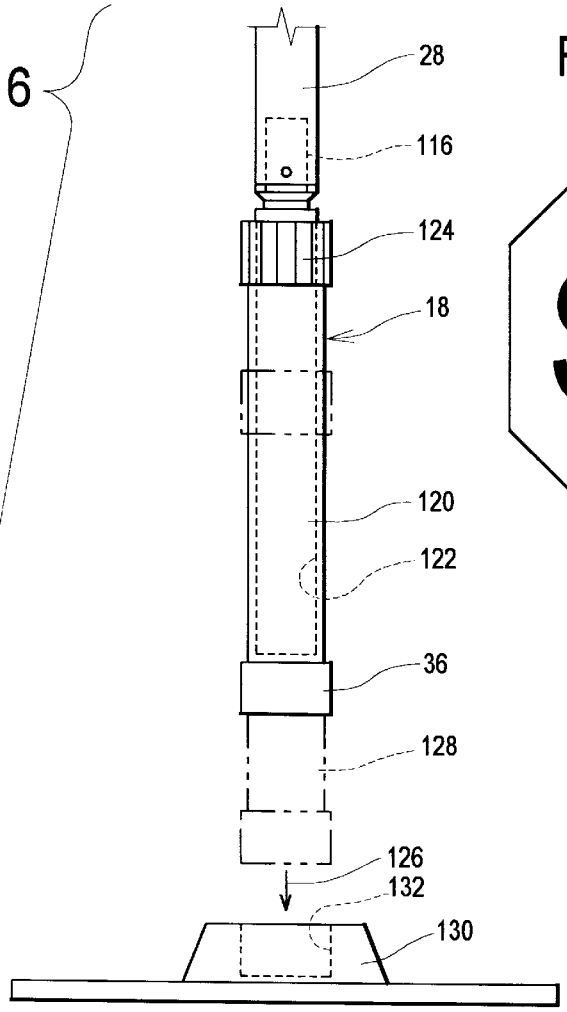
FIG. 6 is an elevational view showing the telescoping pole assembly of the sign assembly of FIGS. 1A–1B, and the support plate for receiving the bottom end of this.

FIG. 6 shows the manner in which the pole assembly 18 can be selectively extended by the operator to varying lengths.

As can be seen, the pole assembly includes two (or more) tubular stanchion members 120, 122, which are concentrically nested in telescoping relationship. These may be constructed of any suitable material, with PVC plastic being eminently suitable for this purpose. In the embodiment which is illustrated, the inner tubular stanchion member 122 is fixedly attached to the lower cylindrical plug section 116 of the male coupler 102, at the lower end of the tubular housing 28. The outer tubular station member, in turn, has a locking ring 124 at its upper end, which can be rotated between first and second positions. In the counter-clockwise position this releases from the inner tubular stanchion member so as to form a sliding engagement therewith, so that the outer station member 120 can be extended downwardly relative to the inner member, in the direction indicated by arrow 126 in FIG. 6.

When the desired extension length has been reached, as indicated by broken line image 128, the locking ring is rotated to its clockwise position, in which it fixedly engages the inner tubular member, locking the telescoping assembly in position.

In its extended configuration, the height of the sign assembly may be substantially greater than that in which it can be conveniently held by an operator. For this purpose, a base assembly 130 is provided, having a socket portion 132 which is sized to receive and support the bottom end of the telescoping pole assembly; accordingly, the operator can simply switch the warning light/horn assembly on and then insert the pole assembly into the socket so that the sign will be supported upright by the base unit.

e. Hand-Held Sign Assembly

Figure 7:
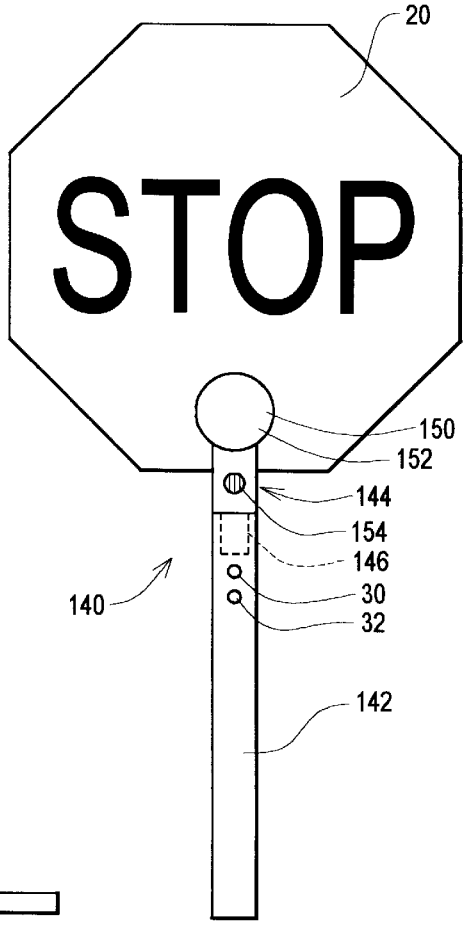
FIG. 7 is an elevational view of a hand-held warning sign assembly in accordance with another embodiment of the present invention.

FIG. 7 shows an embodiment of the present invention which is particularly adapted for use as a hand-held sign, and which may therefore lack the telescoping pole assembly described above. The hand-held flagging unit is particularly suitable for uses where portability is important, such as for some school crossings and for carrying in the trunks of police cars and other vehicles.

Accordingly, as is shown in FIG. 7, it can be seen that the hand-held sign assembly 140 includes the power/control assembly 142 which is substantially similar to the corresponding assembly 116 described above, having finger operated control buttons 30, 32.

The power/control assembly 142, which is sized to be conveniently held in one hand, is connected to a combined visual/audible warning assembly 144 by means of a male/female coupler pair 146 substantially similar to that described above. In this embodiment, however, the visual/audible warning assembly 144 is preferably positioned at the base of the sign plate 20 so as to provide the assembly with better balance for hand-held use.

The light unit which is shown in FIG. 7, and which may also be used in the other embodiments of the present invention, includes a single strobe light 150 which illuminates both sides of the sign, through an opening in plate 20. On the "STOP" side, the light unit is provided with a red lens 152, while the opposite side of the sign plate (having the "SLOW" legend) has an amber lens; in other embodiments, the legend on both sides may read "POLICE" and the light may be provided with blue lenses on both side or "FIRE" with red lenses, "CAUTION" with amber lenses on both sides, and so on. The horn unit 154, in turn, is substantially similar to that described above with reference to FIG. 2A, and is configured to project the audible warning signal outwardly from both sides of the sign assembly.

f. Remote Power Pack

Figure 8:
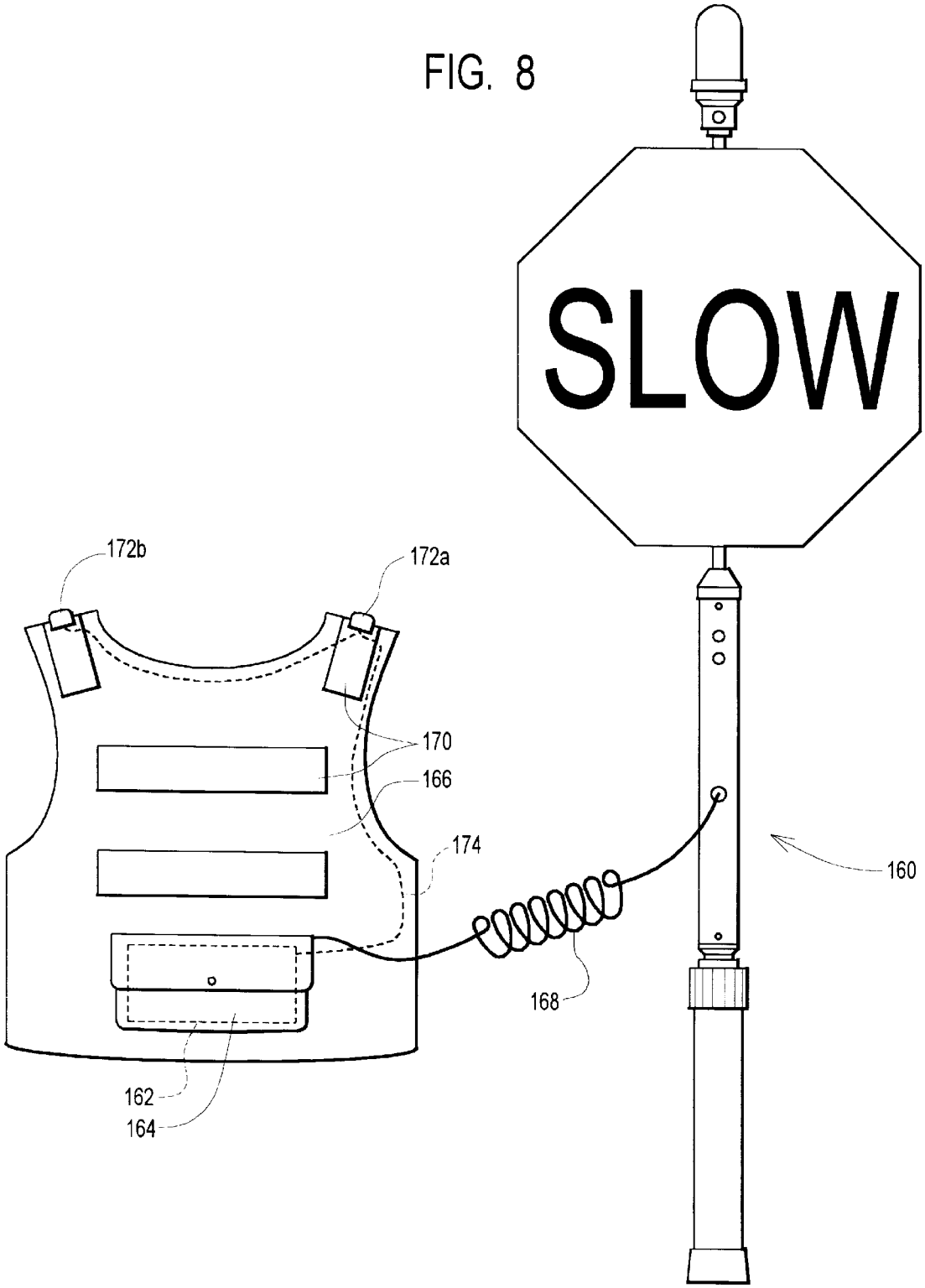
FIG. 8 is an elevational view of a sign assembly in accordance with another embodiment of the present invention, in which power supplied from a remote battery pack carried in a safety vest which is worn by the operator.

FIG. 8 shows an embodiment of the present invention in which the sign assembly 160 is substantially identical to that which has been described above with reference to FIGS. 1–6, except that the battery pack 162 is remotely located from the tubular power/control assembly, in a pouch 164 in a construction safety vest 166. The battery pack pouch 164 may be in the form of a "fanny pack" on the back of the vest as shown in FIG. 8, or there may be a front-mounted pocket. The remote battery pack 162 is connected to the sign assembly 160 by a coiled electrical cord 168 which provides the operator with freedom of movement.

This arrangement permits the use of heavier, longer duration battery packs, which can also be changed without taking the sign assembly apart. Also, because the safety vest 166 (which is preferably provided with reflective patches/strips 170 and other visibility features) must generally be worn by workers on many job sites, this poses virtually no additional burden for the worker.

Furthermore, the safety vest itself can be provided with one or more strobe or other flashing light units 172*a,b* which receive power from the battery pack via a second lead 174. This greatly increases the visibility of the worker to oncoming traffic; as is shown in FIG. 8, the light units 172 are preferably mounted atop both shoulders of the vest for maximum visibility from all directions.

It is to be recognized that various alterations, modifications, and/or additions may be introduced into the constructions and arrangements of parts described above without departing from the spirit or ambit of the present invention as defined by the appended claims.

What is claimed is:

1. A hazard warning sign assembly comprising:

a sign plate having at least one display surface for displaying a warning message;

flashing light means mounted adjacent said display surface for generating a visual warning signal;

horn means mounted to said sign plate for generating an audible warning signal;

an elongate battery pack assembly mounted to a lower end of said sign plate so as to form a handle member therefor, said battery pack assembly being connectable to said sign plate for supplying electrical power to said horn means and said flashing light means and having an elongate tubular housing which forms a battery chamber for holding a plurality of cylindrical batteries in end-to-end relationship;

switch means for selectively actuating said horn means and said flashing light means so as to draw attention to said sign plate; and telescoping pole means mounted to a lower end of said elongate housing of said battery pack assembly, said telescoping pole means being selectively extensible so as to adjust an overall height of said warning sign assembly.

2. The warning sign assembly of claim 1, further comprising:

a support base having a socket portion for receiving a lower end of said telescoping pole means so as to hold said sign assembly upright.

3. The warning sign assembly of claim 1, further comprising:

a signal housing for mounting said horn means and said flashing light means together adjacent said display surface of said sign plate.

4. The warning sign assembly of claim 3, wherein said signal housing is mounted to an upper end of said sign plate opposite said elongate tubular housing of said battery pack assembly so that said horn means and flashing light means are positioned at an uppermost end of said sign assembly when said assembly is held upright.

5. The warning sign assembly of claim 4, further comprising:

support means for connecting said elongate tubular battery housing to said signal housing atop said sign plate.

6. The warning sign assembly of claim 5, wherein said support means comprises:

a tubular rod member extending from said elongate battery housing to said signal housing, said rod member having a hollow tubular core for receiving wire leads interconnecting said battery means with said horn and flashing light means and a vertically extending slot for receiving said sign plate edgewise therein.

7. The warning sign assembly of claim 1, wherein said switch means comprises:

at least one switch button mounted to an upper end of said tubular housing adjacent a lower edge of said sign plate for convenient actuation while holding said handle member.

8. A hazard warning sign assembly comprising:

a sign plate having at least one display surface for displaying a warning message;

flashing light means mounted adjacent said display surface for generating a visual warning signal;

horn means mounted to said sign plate for generating an audible warning signal;

switch means for selectively actuating said horn means and said flashing light means so as to draw attention to said warning sign;

an elongate battery pack assembly mounted to a lower end of said sign plate so as to form a handle member therefor, said battery pack assembly being connectable to said sign plate for supplying electrical power to said horn means and having an elongate tubular housing which forms a battery chamber for holding a plurality of cylindrical batteries in end-to-end relationship;

means for detachably connecting said sign plate and said horn and flashing light means to said elongate tubular housing of said battery pack assembly so that said battery pack assembly can be selectively detached therefrom; and means for selectively connecting said battery pack assembly to a battery charger unit for recharging of said batteries therein.

9. A hazard warning sign assembly comprising:

a sign plate having at least one display surface for displaying a warning message;

flashing light means mounted adjacent said display surface for generating a visual warning signal;

horn means mounted to said sign plate for generating an audible warning signal;

switch means for selectively actuating said horn means and said flashing light means so as to draw attention to said warning sign;

an elongate battery pack assembly mounted to a lower end of said sign plate so as to form a handle member therefor, said battery pack being connectable to said warning sign plate for supplying electrical power to said horn means and said flashing light means and having an elongate tubular housing which forms a battery chamber for holding a plurality of cylindrical batteries in end-to-end relationship;

a signal housing for mounting said horn means and said flashing light means together adjacent said display surface of said sign plate, said signal housing being mounted to an upper end of said sign plate opposite said elongate tubular housing of said battery pack assembly so that said horn means and flashing light means are positioned at an uppermost end of said sign assembly when said assembly is held upright;

support means for connecting said elongate tubular housing of said battery pack assembly to said signal housing atop said sign plate, said support means comprising a tubular rod member extending from said elongate housing to said signal housing, said rod member having a hollow tubular core for receiving wire leads interconnecting said battery means with said horn and flashing light means and a vertically extending slot for receiving said sign plate edgewise therein;

telescoping pole means mounted to a lower end of said elongate housing, said telescoping pole means being selectively extensible so as to adjust an overall height of said warning sign assembly;

means for detachably mounting said sign plate and said signal housing to an upper end of said elongate housing of said battery pack assembly; and means for detachably mounting said telescoping pole means to a lower end of said elongate housing of said battery pack assembly.

10. The sign assembly of claim 9, wherein said means for detachably mounting said sign plate and signal housing to said upper end of said elongate housing of said battery pack assembly comprises:

a tubing reducer member having a cylindrical plug portion which is received in an upper end of said tubular housing and a threaded bore; and a threaded lower end of said rod member which is threadedly receivable in said bore of said tubing reducer.

11. The sign assembly of claim 10, wherein said means for detachably mounting said telescoping pole means to said lower end of said elongate housing of said battery pack assembly comprises:

a first coupler member having a cylindrical plug portion which is received in a lower end of said tubular housing and a threaded bore; and a second coupler member having an extension portion which is mounted to said telescoping pole means and a threaded stud portion which is threadedly receivable in said bore in said first coupler member.

* * * * *